United States Patent [19]

Glass

[11] 3,978,700

[45] Sept. 7, 1976

[54] SAFE DEPOSIT LOCK CONSTRUCTION WITH CHANGEABLE TUMBLER MECHANISM

[75] Inventor: Dwight W. Glass, Rockford, Ill.

[73] Assignee: Keystone Consolidated Industries, Inc., Peoria, Ill.

[22] Filed: Jan. 8, 1975

[21] Appl. No.: 539,497

[52] U.S. Cl. ..... 70/339; 70/355; 70/384

[51] Int. Cl.[2] ..... E05B 25/00

[58] Field of Search ..... 70/339, 340, 341, 342, 70/343, 353, 354, 355, 382, 383, 384

[56] References Cited

UNITED STATES PATENTS

| | | | |
|---|---|---|---|
| 1,259,353 | 3/1918 | Brintnall | 70/384 |
| 1,431,381 | 10/1922 | Diesel | 70/385 |
| 1,543,447 | 6/1925 | Marvel | 70/385 |
| 2,524,696 | 10/1950 | Ellis | 70/355 X |
| 3,514,982 | 6/1970 | Bergendahl | 70/384 X |
| 3,772,904 | 11/1973 | Parrock | 70/339 |
| 3,837,196 | 9/1974 | Gartner | 70/339 |

FOREIGN PATENTS OR APPLICATIONS

| | | | |
|---|---|---|---|
| 52,872 | 1/1942 | Netherlands | 70/339 |

*Primary Examiner*—Robert L. Wolfe
*Attorney, Agent, or Firm*—Allegretti, Newitt, Witcoff & McAndrews

[57] ABSTRACT

A lock construction for a safe deposit box requires two keys for operation of the bolt. The first key is provided by the vault guard and the second key is provided by the customer. Each key activates a separate set of wafer-like tumblers by rotating the tumblers in response to rotation of the key. Each set of tumblers includes a plurality of key engaging drive tumblers which are gear engaged with gate tumblers. Appropriate rotation of the keys orients a notch of the gate tumblers that permits withdrawal of the bolt. Stops are provided on the bolt cooperative with key operated shifters to insure sequential operation of the keys. A change key tool may be inserted from the back side of the lock to disengage the drive and gate tumblers. Subsequent to disengagement of the tumblers, it is possible to substitute one or both of the keys and thus change the relative gear engagement of the tumblers. Unique features of the security lock include the tumbler drive mechanism, the key combination change mechanism and the stop arrangement that insures sequential operation of the keys.

13 Claims, 17 Drawing Figures

SAFE DEPOSIT LOCK CONSTRUCTION WITH CHANGEABLE TUMBLER MECHANISM

BACKGROUND OF THE INVENTION

This invention relates to a security lock and, in particular, to a lock for vaults requiring more than one key for operation of the lock.

Safe deposit or lock boxes generally require two keys. One of the keys is retained by the bank or financial institution. The second key is retained by the customer who rents the box or vault. Before the box or vault can be opened, it is necessary to insert both of the keys in the lock and turn them in a prescribed sequential fashion. Failure to use the customer's key will prevent operation of the lock, thereby insuring that only the customer will have access to the lock box. Failure to use the bank or guard key will prevent unauthorized entry into the lock box. That is, the person who is to enter the lock box must properly identify himself to the bank security personnel and then be accompanied by such personnel during the opening of the lock box.

Dual key lock constructions have been available for many years. An early patent disclosing such a construction is U.S. Pat. No. 853,486 patented May 14, 1907 by H. P. Townsend. It is desirable that such locks be of solid and secure construction. It is also desirable that such locks have the capability of multiple combinations. Duplicate keys or identical keys for different locks should be avoided. Additionally, such locks should be constructed, if possible, in a manner which will permit changing the lock combination with ease and maximum security. Such a change would be needed, for example, whenever rental of a lock box is terminated by one customer and begun by a new customer. Preferably, the new customer should have a different lock box combination or key to insure that the key which that customer will be using is unique. Another feature desired in a lock box security unit is the inclusion of a bolt which moves longitudinally into engagement with the strike associated with the lock box and includes a dead lock feature. These are some of the objectives and criteria for a high security lock box lock construction.

SUMMARY OF THE INVENTION

In a principal aspect, the present invention comprises an improved multiple key lock assembly which includes a housing, a bolt translatable in the housing between a projected, locked position and a retracted, unlocked position by key operated shifters, at least two gate tumblers cooperative with the bolt to maintain that bolt in a locked position or permit withdrawal of a bolt to an unlocked position, and means for rotating and operating the tumblers between the locked and unlocked position. The means for rotating the gate tumblers includes drive tumblers which radially engage the gate tumblers and rotate them to a desired locked or unlocked position. The tumblers are generally biased in a first direction by biasing means. Additional means are provided for disengaging the gate tumblers and the drive tumblers to effect a change in the radial relationship between those tumblers, thus permitting a change in keys for operation of the lock. Various stops are provided on the bolt and in the housing to insure appropriate sequential operation of the keys as well as dead locking action for the bolt.

It is therefore an object of the present invention to provide an improved multiple key security lock construction.

It is a further object of the present invention to provide an improved multiple key security lock construction including a mechanism for changing the key or keys that may be used to operate the lock construction.

Still another object of the present invention is to provide an improved security lock construction including sets of radially engaged tumblers which rotate to permit operation of a translatable bolt.

Another object of the present invention is to provide a lock having a dead bolt locking action and an arrangement of stops operative to require a definite, sequential key operation when being locked, unlocked and when changing keys.

One further object of the present invention is to provide a lock capable of providing a multiplicity of key combinations which may be set subsequent to installation of the lock in a vault. The lock also has the capability of a change in combination in the field subsequent to installation.

These and other objects, advantages and features of the invention will be set forth in the detailed description which follows.

BRIEF DESCRIPTION OF THE DRAWING

In the detailed description which follows, reference will be made to the drawings comprised of the following figures.

DESCRIPTION OF THE PREFERRED EMBODIMENT

Figure 1:
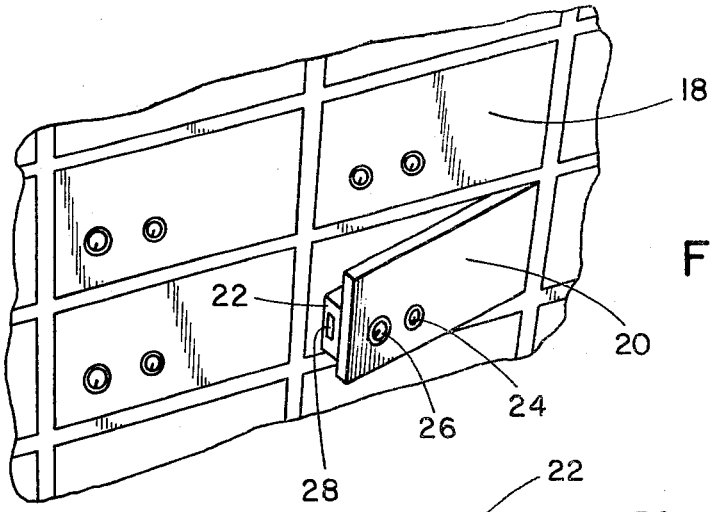
FIG. 1 is a perspective view of the improved lock of the present invention as installed in a typical bank vault lock box.
Figure 2:
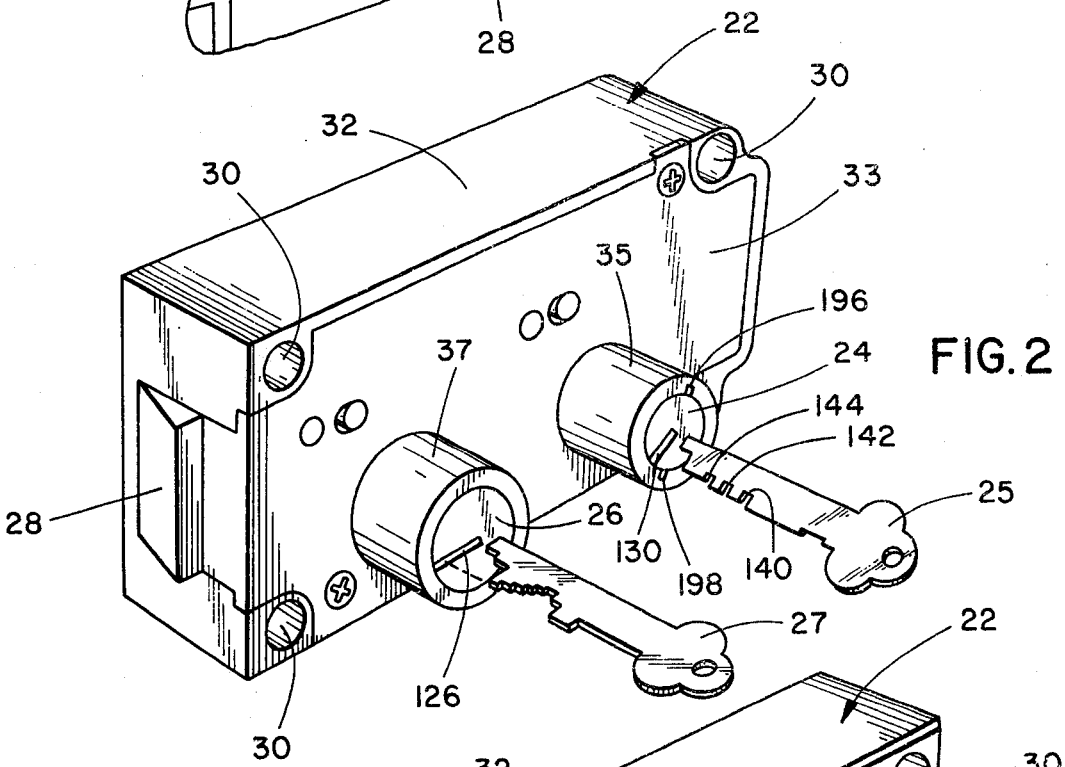
FIG. 2 is an enlarged front perspective view of the improved security lock of the present invention.
Figure 3:
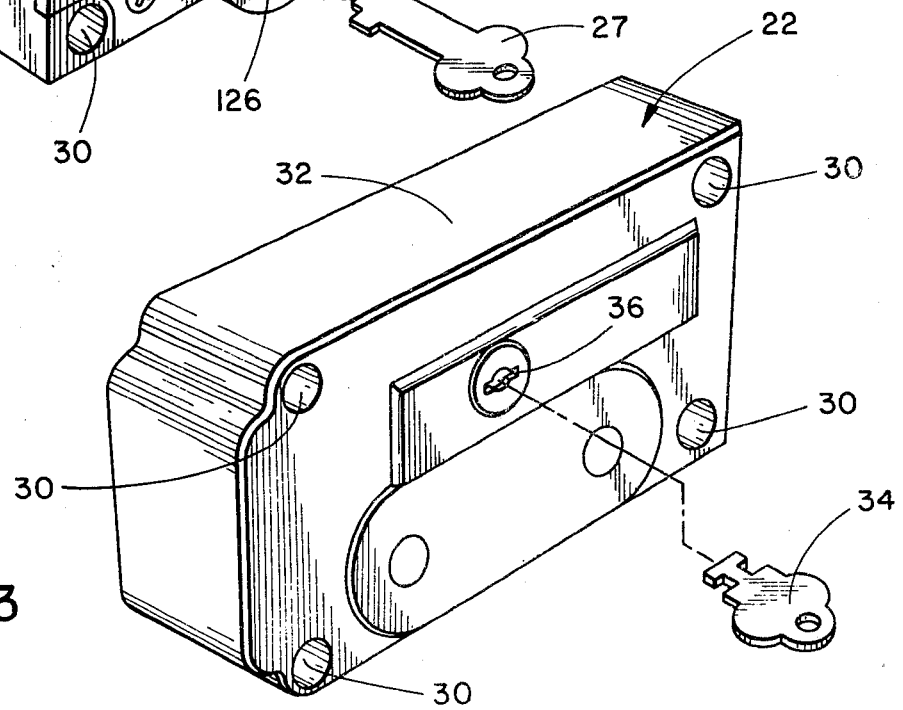
FIG. 3 is a back perspective view of the lock of FIG. 2.

Referring to the figures and, in particular, FIG. 1, the lock of the present invention has particular application as a security lock for lock boxes of the type commonly called safe deposit boxes. As shown in FIG. 1, a safe deposit box 18 includes a vault door 20 having a lock mechanism 22 attached thereto. Generally, a great number of safe deposit boxes 18 each of which includes a door 20 are maintained in a vault area of a bank or other similar financial institution. Hotels and other businesses likewise utilize safe deposit boxes of the type illustrated in FIG. 1. First and second key receiving guides 24 and 26 extend through the door 20 for receipt of a guard key 25 and a customer key 27 respectively. Keys 25 and 27 are illustrated in FIG. 2. Appropriate operation of the keys 25 and 27 will move a bolt 28 between a retracted, unlocked position and a projected, locked position. The door is normally hinged at the side opposite the bolt 28.

The following description relates to a lock associated with a safe deposit box. However, the lock is not limited to such use. Moreover, the following description relates to a lock utilizing two keys, a guard key 25 and a customer key 27. The use of two keys is likewise not to be construed as a limitation. That is, the subject matter of the present invention has application in many areas involving locks and security devices using one or more keys, though the following description will be directed in general, to a two key, safe deposit, lock box type construction.

Referring next to FIG. 2, the lock mechanism 22 is attached to door 20 by means of fasteners (not shown) passing through openings as at 30 defined in a lock housing 32. A change key tool 34 is provided for operation of a key or combination changing mechanism through key hole 36 defined in the back side of housing 32. Thus, a change in keys can be effected only when door 20 is open to reveal the back side of housing 32.

Figure 4:
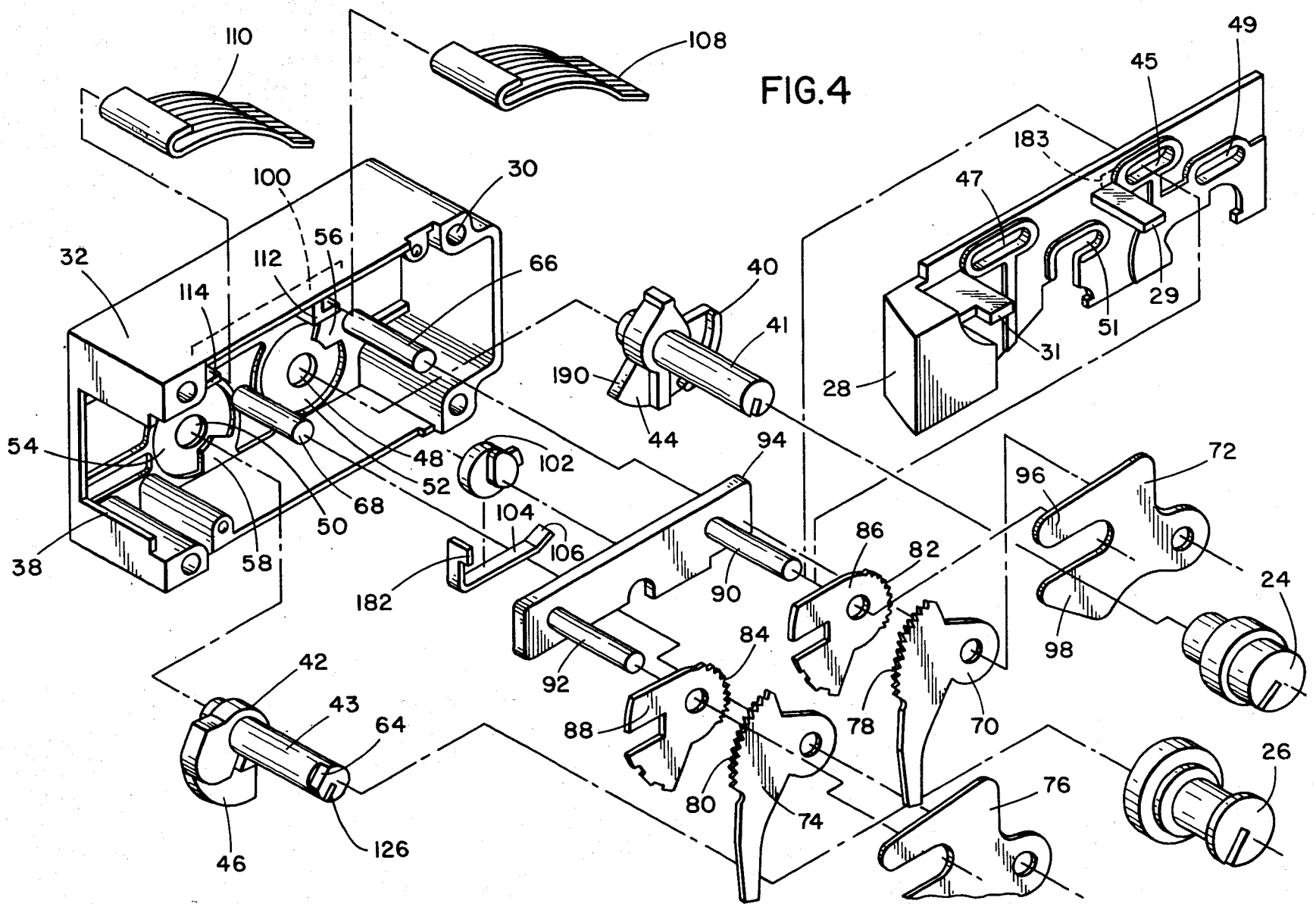
FIG. 4 is an exploded perspective view of the lock of the present invention.

Reference is now made to FIG. 4 which is an exploded perspective view illustrating the internal construction and configuration of the lock of the present invention. Various parts comprising the lock mechanism are maintained within the housing 32, by a cover plate 33.

Bolt 28 is slidably mounted within the housing 32 so that it projects through the opening 38 in one side of the housing 32. The bolt 28 is driven between projected and retracted positions by rotatable shifters 40 and 42 pivotally mounted on the inside of housing 32. Shifters 40 and 42 cooperate with various cam surfaces of the bolt 28 as explained in more detail below. The shifters 40 and 42 include a center shaft 41 and 43 respectively and a precisely shaped cam member 44 and 46 respectively. The precise configuration and construction of the cam members 44 and 46 is also described below. The rear or bottom ends of shafts 41 and 43 respectively fit through openings 48 and 50 respectively in the housing 32 with the cam members 44 and 46 being nested in the depressions 52 and 54 respectively. Projecting flanges 56 and 58 of housing 32 cooperate with the cam members 44 and 46 respectively to limit the rotation that may be imparted to the shafts 41 and 43 respectively.

Figures 10, 11:
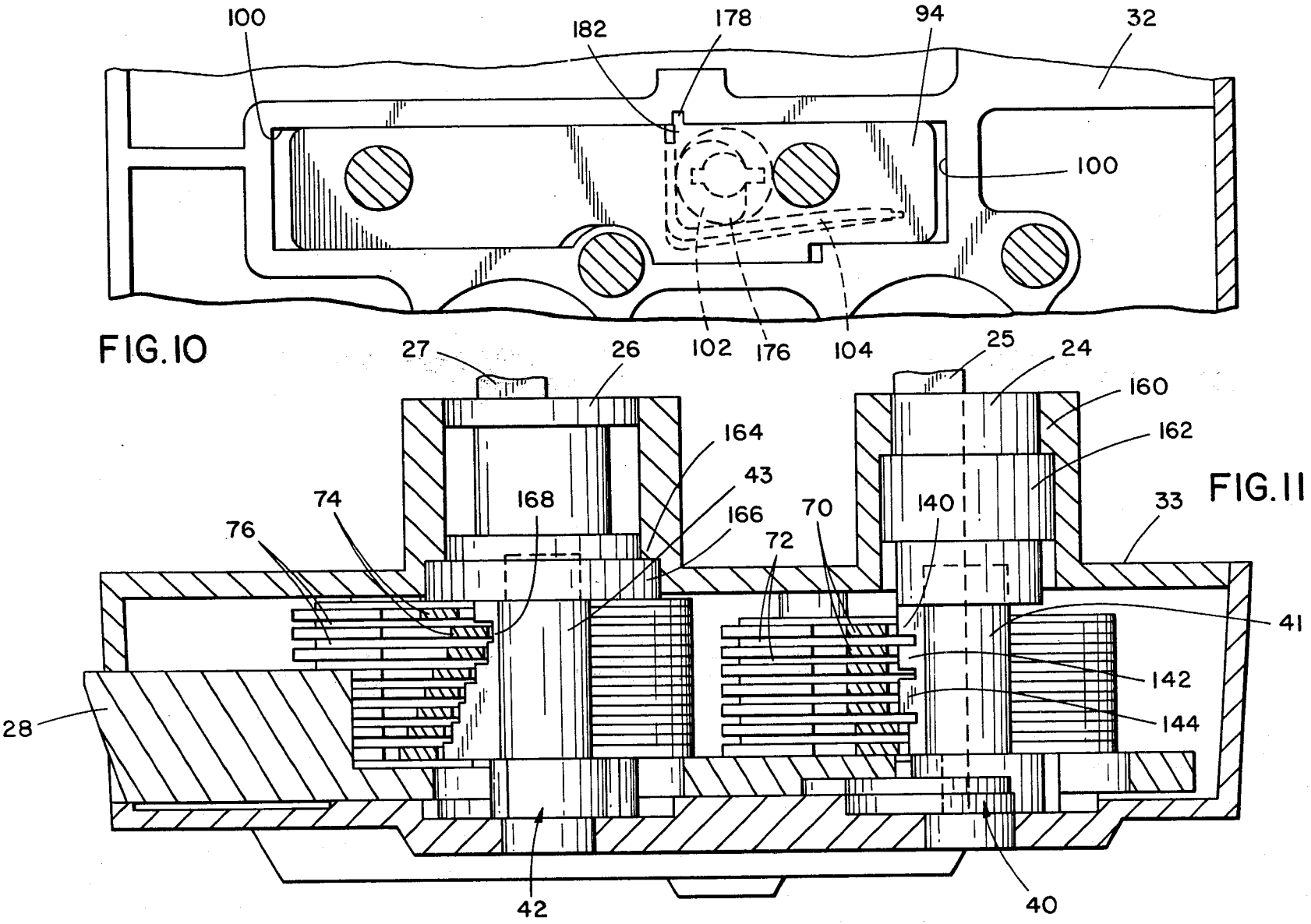
FIG. 10 is a cross-sectional view similar to FIG. 9 wherein the key changing mechanism illustrated in FIG. 9 has been shifted to its alternate position.
FIG. 11 is a cut-away cross-sectional view taken along the line 11—11 in FIG. 7.

Shaft 41 receives a guard key guide 24. The guard key guide 24 is maintained against the shaft 41 by means of cover plate 33 as shown in FIG. 2 and FIG. 11. In particular, cylindrical casing 35 projecting from cover 33 maintains guide 24.

In a similar manner, shaft 43 receives customer key guide 26. The customer key guide 26 is keyed on shaft 43 and is maintained thereon by casing 37 as also shown in FIG. 2 and FIG. 11. Thus, shaft 43 includes a flat keying surface 64 to insure that guide 26 and shaft 43 rotate in unison. By comparison, key guide 24 is not keyed to shaft 41.

Bolt 28 includes first and second locking projections 29 and 31 respectively which cooperate with gate tumblers 86 and 88 as described below. Additionally, longitudinal openings or slots 45 and 47 are provided for receipt of posts 90 and 92 respectively. A second set of slots 49 and 51 in bolt 28 receive posts 66 and 68 respectively.

First and second drive tumbler mounting posts 66 and 68 extend from the bottom surface of housing 32 and through slots 49 and 51 of bolt 28. Guard key drive tumblers 70 and spacers 72 are alternately positioned on the post 66 and seat against bolt 28. In similar fashion, drive tumblers 74 associated with the customer key and spacers 76 are mounted on the other post 68.

Tumblers 70 and 74 include teeth 78 and 80 respectively which cooperate with teeth 82 and 84 respectively of guard key gate tumblers 86 and customer key gate tumblers 88 respectively. The gate tumblers 86 and 88 are also mounted in spaced relationship on posts 90 and 92 of a shift bar 94. Posts 90 and 92 extend through slots 45 and 47 respectively of bolt 28. Adjacent the gate tumblers 86 on posts 90 are maintained in spaced relationship by projecting arms 96 and 98 of the spacers 72 which embrace the posts 90. Similarly, spacers 76 serve to space adjacent tumblers 88 on post 92. Note that the tumblers 70, 74, 86 and 88 as well as spacers 72 and 76 are all planar or wafer type elements.

The bar 94 is mounted in a channel 100 in the base of housing 32. The bar 94 is translatable back and forth in the channel 100 in the same directions as the bolt 28 and is positioned intermediate bolt 28 and channel 100. Positioned intermediate the bar 94 and the channel 100 is a bar shifter 102. A locking leaf spring 104 cooperative with shifter 102 is also positioned intermediate the bar 94 and channel 100, spring 104 having an end 106 affixed to the housing 32. The opposite end of spring 104 acts as a cantilver that engages shifter 102.

A tumbler leaf spring 108 includes a plurality of spring blades each one of which engages one of the drive tumblers 70 tending to rotate each drive tumbler 70 in the counterclockwise direction as viewed in the figures. In similar fashion, a tumbler leaf spring 110 includes spring blades to engage drive tumblers 74.

The general description of the parts comprising the lock of the present invention has been set forth above. These components are now described in further detail relative to the various operational steps which are performed by the lock.

LOCKED POSITION

Figure 5:
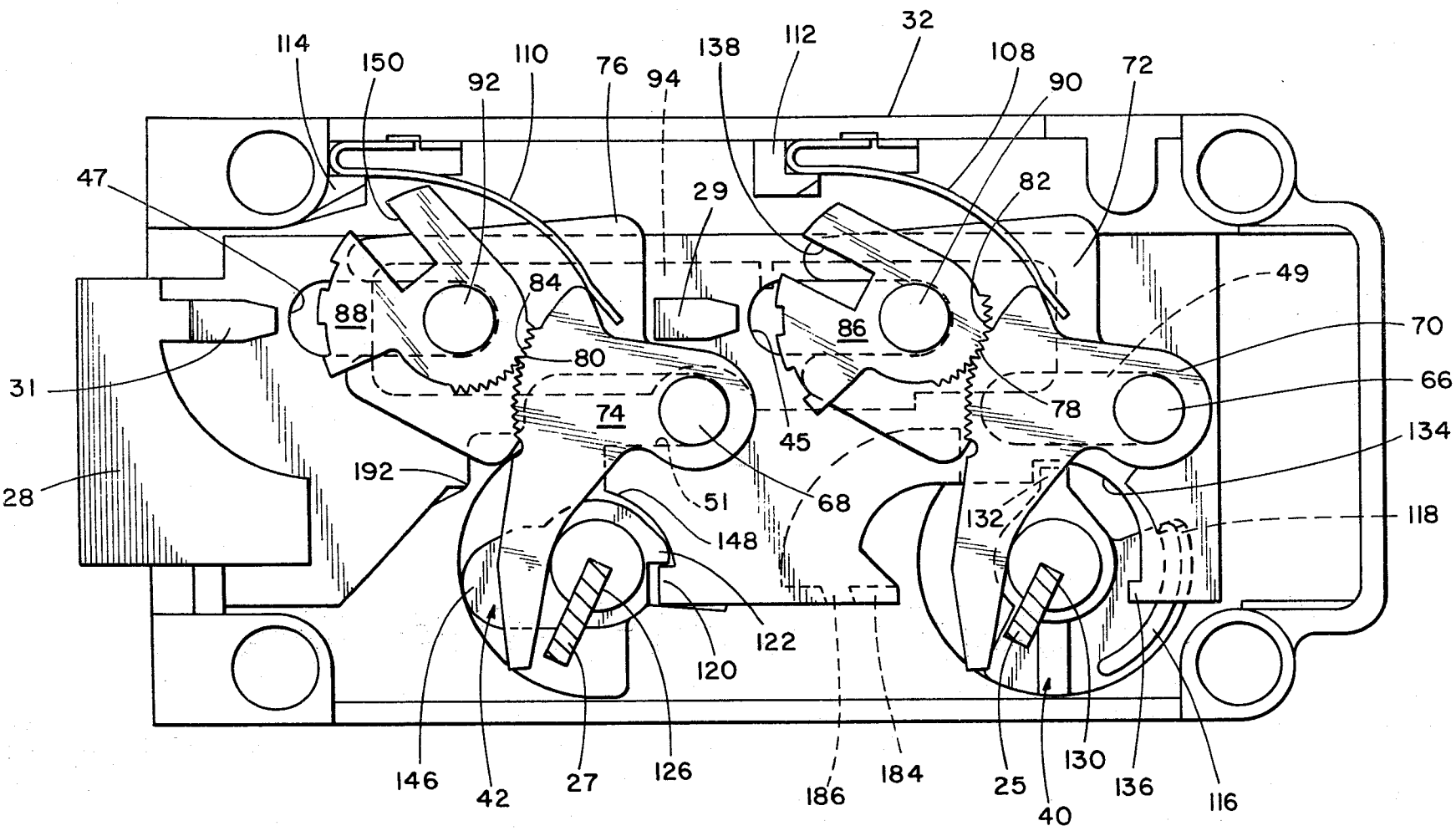
FIG. 5 is a plan view of the lock of the present invention in the locked position.

FIG. 5 illustrates the internal arrangement of the various components of the lock when the lock is in the bolt locked position. When in this position, the bolt 28 is in its extreme projected position. Consequently, posts 90 and 92 associated with bar 94 are maintained at the right-hand side of slots 45 and 47 respectively. Posts 66 and 68 projecting from the bottom surface of housing 32 are similarly positioned in slots 49 and 51.

When in this position, the locking or gate tumblers 86 and 88 are disengaged from bolt locking projections 29 and 31 respectively. The teeth of tumbler 86 are, however, meshed with teeth 78 of tumbler 70. In similar fashion, teeth 84 of tumbler 88 mesh with teeth 80 of tumbler 74.

Spring 108 is mounted in a channel 112 of housing 32. As previously described, the spring 108 is comprised of a plurality of parallel cantilver leaf blades having a width approximately equal to the width of each tumbler 70 and being spaced approximately equal to the thickness of spacer 72. In this manner, each separate cantilever leaf blade of spring 108 engages a separate tumbler 70 in the series of stacker tumblers 70 on post 66. Each tumbler 70 is thus biased in a counterclockwise direction. Since the teeth 78 of tumbler 70 engage teeth 82 of tumbler 86, the tumbler 86 is effectively biased in the clockwise direction. The relative position of engagement of teeth 78 and 82 (i.e., the radial relationship of tumblers 70 and 86) determines the amount of bias or rotation imparted by tumbler 70 to tumbler 86. As described below, this relationship can be changed to effect a change in the key combination of the lock.

The spring 110 is also mounted in a channel 114 and includes a plurality of separate cantilever leaf blades, each blade corresponding to a single tumbler 74 and serving to bias that tumbler 74 in a counterclockwise direction. Associated gate or locking tumblers 88 are biased in the clockwise direction by the cooperative action of teeth 80 and 84. Again, the amount of relative rotation is dependent upon the teeth 78, 82 which are engaged.

Figure 14:
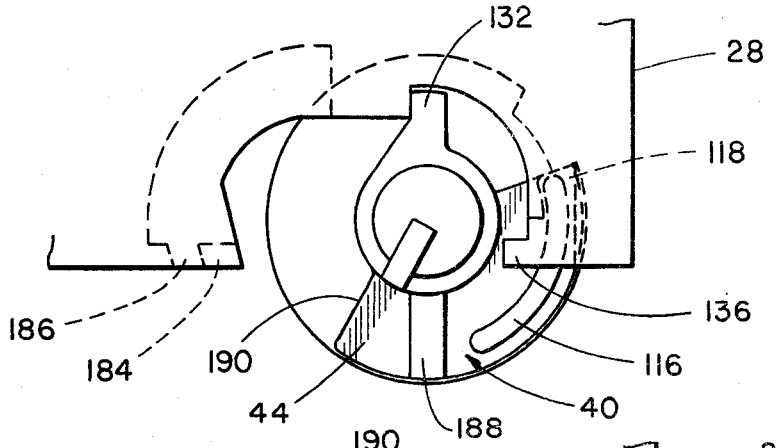
FIG. 14 is an enlarged cut-away plan view of the bolt and key mechanism for the guard's key wherein the key has been removed and the bolt is in the dead lock position.

When in the locked position as mentioned previously, the bolt 28 is in its most projected or forward position and extends through an appropriate strike. The shifter 40 includes a dead locking mechanism for the bolt 28. This is illustrated in greater detail in FIG. 14. In particular, the cam member 44 associated with the guard key 25 includes an arcuate projection 116 which fits within a pocket 118 defined in the bottom surface of the bolt 28. As a result, it is impossible to move the bolt 28 in either longitudinal direction until the arcuate projection 116 is withdrawn from the pocket 118.

The bolt 28 also includes a forward projecting tab or flange 120 cooperative with a complimentary projection 122 defined in customer cam member 46 attached to shifter 42. Thus, insertion of a customer's key 27 in key slot 126 of post 43 is possible. However, the key 27 cannot be rotated because of the cooperative interaction of projection 122 and flange 120. Consequently, the bolt 28 cannot be retracted without first inserting and slightly rotating the guard key 25 in guard key slot 130 of shifter post 41.

UNLOCKING — FIRST STEP

Figure 6:
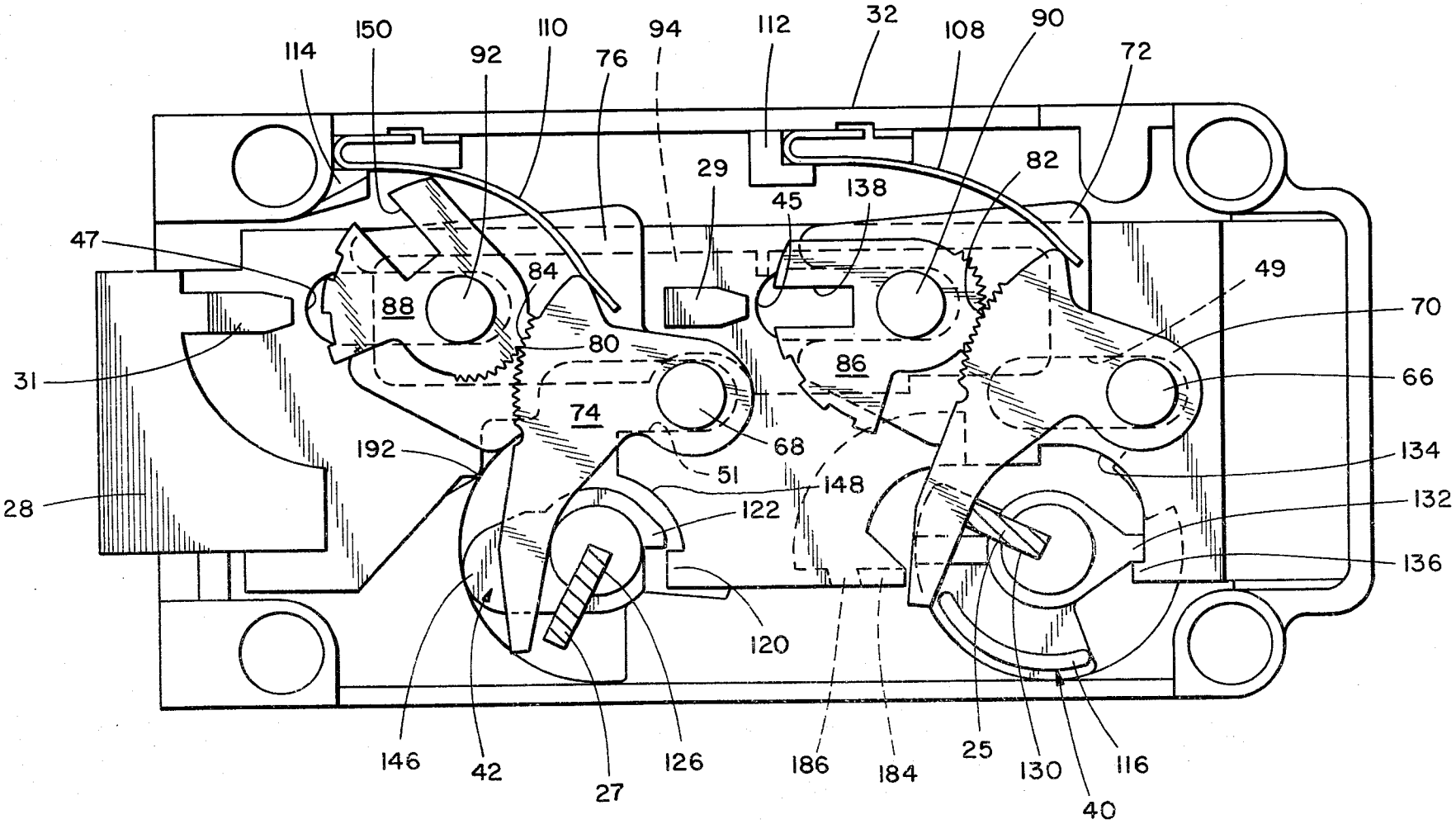
FIG. 6 is a view similar to FIG. 5 wherein the guard key of the lock has been rotated to the unlocked position.
Figure 15:
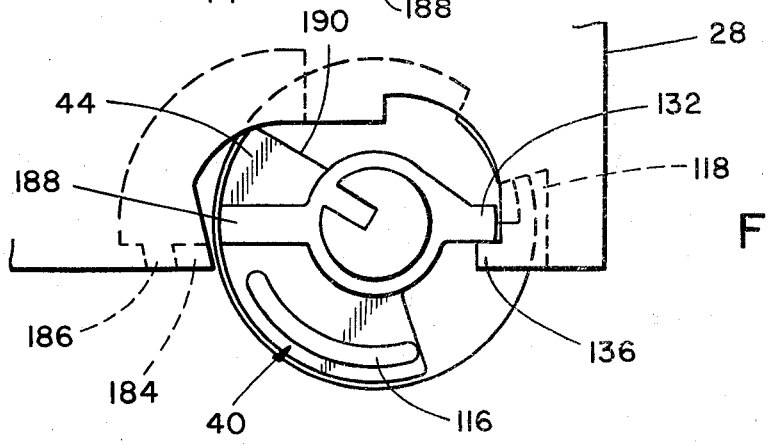
FIG. 15 illustrates the configuration of the bolt and guard key shifting mechanism subsequent to rotation of the guard key through the unlocked position.

FIG. 6 and FIG. 15 illustrate the first step in unlocking the bolt 28. This first step is accomplished by insertion of the guard key 25 in the guard key slot 130 and subsequent rotation of the shifter 40 in a clockwise direction approximately 90°. Rotation of the shifter 40 causes a bolt drive projection 132 of cam member 44 to engage cam surface 134 of bolt 28, thereby slightly retracting the bolt 28 from its extended and dead locked position. The projection 132 engages a stop 136 on the bolt 28 to limit rotation to the 90° amount recited.

Simultaneous with rotation of the shifter post 41, the key 25 engages tumblers 70 rotating tumblers 70 in the clockwise direction. Tumblers 70 through the radial engagement of teeth 78–82 cause counterclockwise rotation of gate tumblers 86. In this manner, gates or notches 138 defined in tumblers 86 are aligned with locking projection 29 of bolt 28. Upon full retraction of bolt 28, the projection 29 will slide within notches 138 of tumblers 86.

It must be kept in mind that a plurality of tumblers 86 are aligned so that a single elongated notch or slot comprised of notches 138 is formed for receipt of projection 29.

Since each tumbler 70 is a substantially planar plate member, a single key surface or key notch 140 in FIG. 2 and FIG. 10 may be associated with each tumbler 70. The depth of the notch 140 determines the amount of clockwise rotation imparted by that notch 140 of key 25 to the associated tumbler 70. This in turn is determinative of the amount of counterclockwise rotation imparted to the associated gate tumbler 86. To insure that the appropriate rotations are effected, teeth 78 and 82 are appropriately meshed to insure alignment of associated notch 138 with projection 29 subsequent to the 90° rotation of the shifter 40. Other notches adjacent notch 140, for example, notches 142 and 144 in FIG. 2 and FIG. 10, have different depths, the meshed relationship of teeth 78 and 82 of corresponding tumblers 70 and 86 is appropriately altered or set to insure alignment of the notch 138 of tumbler 86 with projection 29. Thus, even though each tumbler 70 in a series of tumblers on post 66 will be rotated a different amount by operation of the key 25, the notch 138 for each tumbler 86 is appropriately and correctly aligned.

UNLOCKING — SECOND STEP

Subsequent to rotation of the guard key 25, as described above, and actuation of the associated tumblers 70 and 86, the customer key 27 may be rotated. This is now possible since the flange 120 and projection 122 are no longer in an interfering relationship. The tab or flange 120 was retracted to the right by operation of the drive projection 132 against the surface 134 as previously described. Therefore, the customer key 27 may be rotated from the position illustrated in FIG. 6 to the position shown in FIG. 7. The key 27 is rotated in the clockwise direction.

Figure 16:
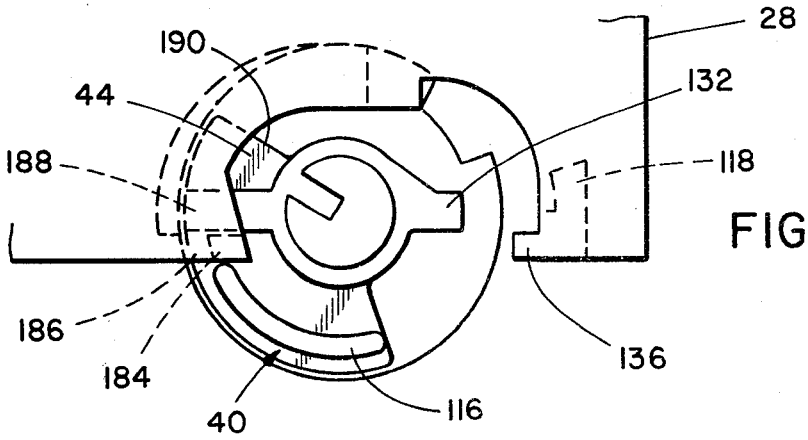
FIG. 16 illustrates the subsequent movement of the bolt relative to the guard key shifting mechanism during the unlocking as effected by the customer's key.

As the customer key 27 is rotated, the shifter 42 is simultaneously rotated a like amount. A cam projection 146 of cam member 46 engages a cam retration surface 148 to withdraw the bolt 28 to the fully retracted position. Previously, of course, the guard key 25 had been operated to withdraw the bolt 28 a small amount enabling operation of the customer key 27. FIG. 16 illustrates how the guard key 25 is trapped by retraction of bolt 28. Arcuate projection 116 and projection 188 of cam member 44 lock with stop 184 of bolt 28.

With rotation of the customer key 27, tumblers 74 are rotated in the clockwise and tumblers 88 are rotated in the counterclockwise direction in the same manner as previously described for tumblers 70 and 86. Likewise, the relationship between the notches of key 27 and the amount of rotation imparted to tumblers 74 and 88 is the same as the relationship previously described for key 25 and tumblers 70 and 86. In this manner then, a notch 150 for each tumbler 88 becomes aligned with associated projection 31 of bolt 28, thereby permitting the projection 31 to slide into the notches 150 of tumblers 88. In the same manner, the projection 29 slides into the notches 138 of tumblers 86.

Note that when the projection 31 fits within the notches 150, the tumblers 88 may no longer be rotated through the action of the tumbler 74 and key 27. This in effect maintains the key 27 in a non-rotatable position. That is, the key 27 cannot be rotated any further in the clockwise direction. The bolt 28 having been withdrawn, it is now possible to open the door to which the security lock construction of the present invention is attached.

Reversal of the sequence of operation serves to lock the bolt 28. In other words, the customer key 27 must first be rotated back to its original position. The customer key 27 may then be withdrawn from the lock box. Subsequently the guard key 25 may be rotated back to its original position illustrated in FIG. 5 and withdrawn from post 41.

Figure 8:
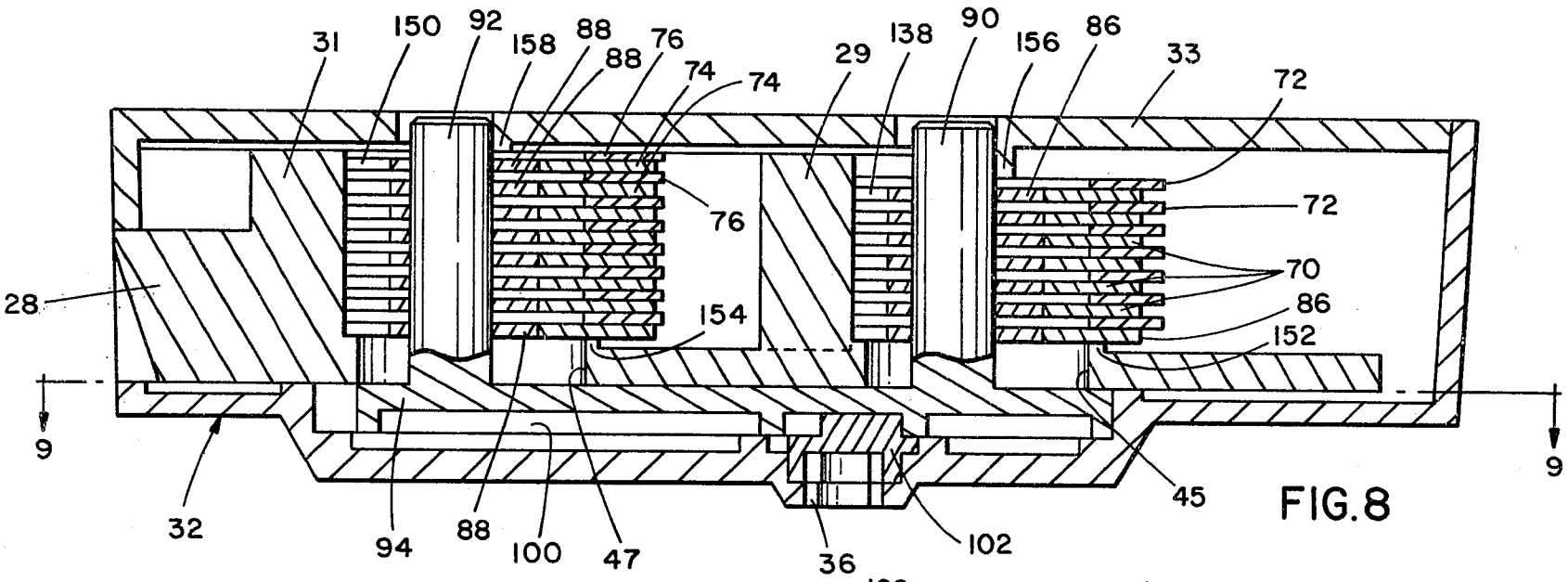
FIG. 8 is a cut-away cross section of the lock of FIG. 7 taken along the line 8—8.

FIGS. 8 and 11 illustrate in more detail the arrangement of the plurality of tumblers and the manner in which those tumblers are driven by the notched keys 25, 27. In FIG. 8, the bar 94 with posts 90, 92 is shown in combination with a plurality of spaced tumblers 86 and 88 respectively. For example, post 90 includes seven tumblers 86 mounted thereon with a spacer 72 positioned between each tumbler 86. Note that the bottom tumbler 86 rides on a flange surface 152 surrounding opening 45 of bolt 28. The cooperating drive tumblers 72 are stacked in the same sequence though, as previously described, tumblers 72 are mounted on posts 66.

Similarly, eight tumblers 88 are mounted on post 92 and cooperate with drive tumblers 74. Tumblers 88 and 76 are likewise separated by spacers 76. The bottom tumbler 88 in the stack of tumblers 88 cooperates with flange 154 of bolt 28.

The cover 33 includes downwardly depending flanges 156 and 158 which engage the stacks of tumblers arranged on posts 90 and 92 respectively. This maintains the tumblers in a snug relationship on the posts 90 and 92 so that they will remain in proper alignment for cooperation with keys 25 and 27 as well as springs 108 and 110.

Figure 7:
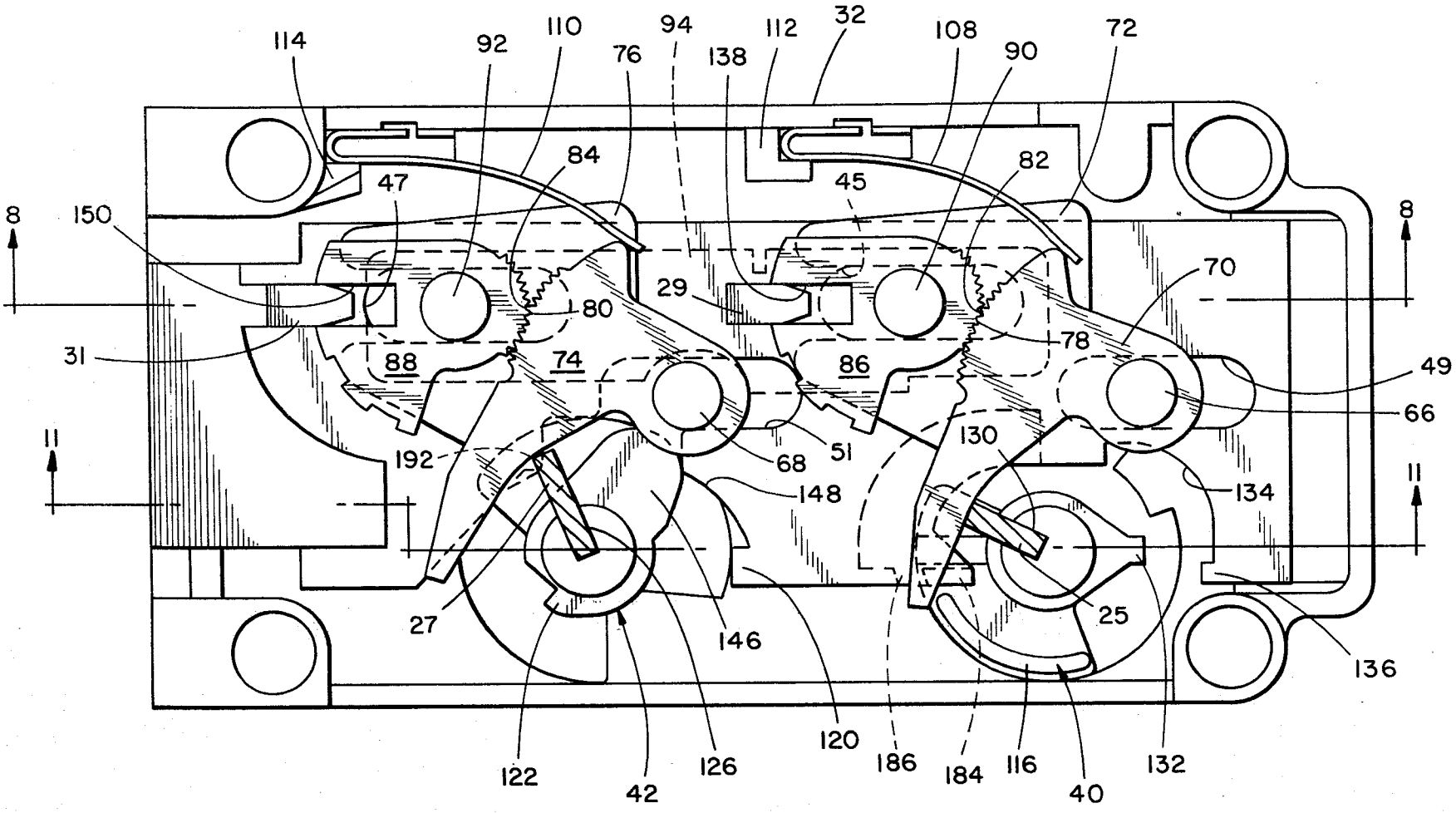
FIG. 7 is a view similar to FIG. 6 illustrating the next sequential step in the unlocking operation of the lock inasmuch as the customer's key has been moved to the unlocking position in order to retract the bolt.

FIG. 7 illustrates the manner in which cover 33 cooperates with key guides 24 and 26 to retain those guides in appropriate position on posts 41 and 43 respectively. Thus, cover 33 includes an annular flange 160 cooperative with the annular rib 162 of key guide 24. Guard key 25 includes notched portions 140, 142, and 144, for example, which cooperate with different tumblers 70 upon rotation as previously described. In a similar fashion, the cover 33 includes a second annular flange 164 cooperative with rib 166 of the key guide 26 to retain the key guide in fixed position on post 43. Key 27 includes various depth notches as at 168 cooperative with tumblers 74 as previously described.

KEY CHANGING OPERATION — FIRST STEP

To effect a change in the combination of the lock, i.e., a change in the keys which open or operate the lock, the relative rotational relationship of a gate tumbler 86 or 84 to its associated drive tumbler 70 or 74 must be altered. The number of alterations possible is, of course, related to the number of interengaging teeth 78, 82, 80, 84 and the amount of rotation which keys 25, 27 impart to tumblers 70, 74. Increased rotation and increased numbers of teeth serve to increase possible combinations.

In any event, this change in the combination is effected by disengaging the gate tumblers 86 and 88 from the associated drive tumblers 70 and 74, rotating the drive tumblers 70, 74 to a relatively new position and reengaging the tumblers 86 and 70 as well as 88 and 74. Following is an explanation of the mechanism for disengaging the tumblers and inserting a new key in order to change the combination of the lock.

Figure 12:
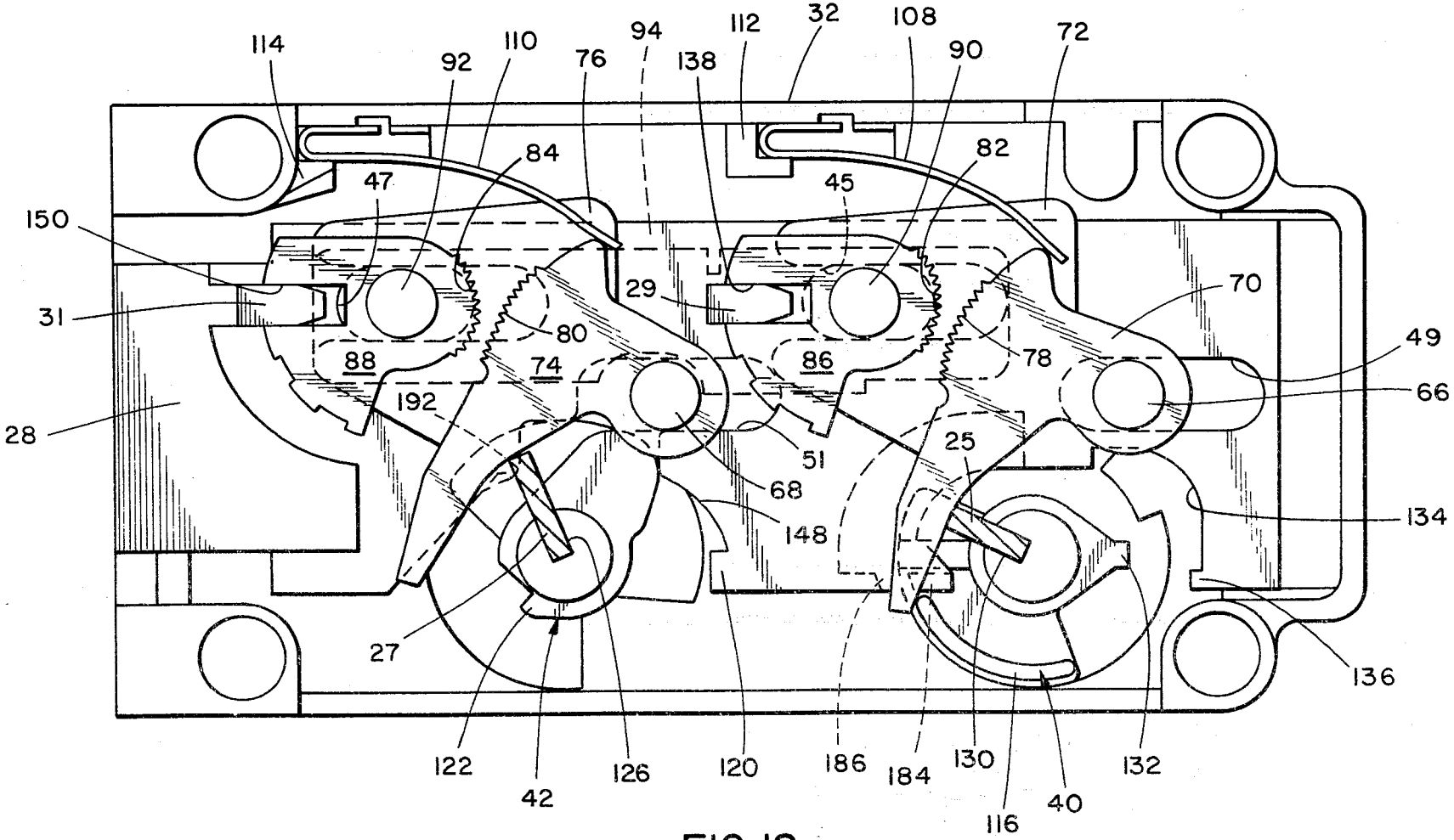
FIG. 12 is a plan view of the internal mechanism of the lock of the present invention similar to FIG. 6 wherein the tumblers of the device have been disengaged to enable rotation of the keys to the key removal position.

To separate the tumblers 86 and 88 from the drive tumblers 70 and 74 respectively, the lock is first placed in the configuration illustrated in FIG. 7. Once this has been accomplished, change key tool 34 is inserted in key hole 36 as shown in FIGS. 3, 8, 9, 10 to effect a translational movement of bar 94 and thus associated posts 90, 92. When posts 90, 92 are translated, the tumblers 86, 88 mounted thereon are likewise translated from a position of engagement with tumblers 70 and 74 as shown in FIG. 7 to a position of disengagement as illustrated in FIG. 12.

Figure 9:
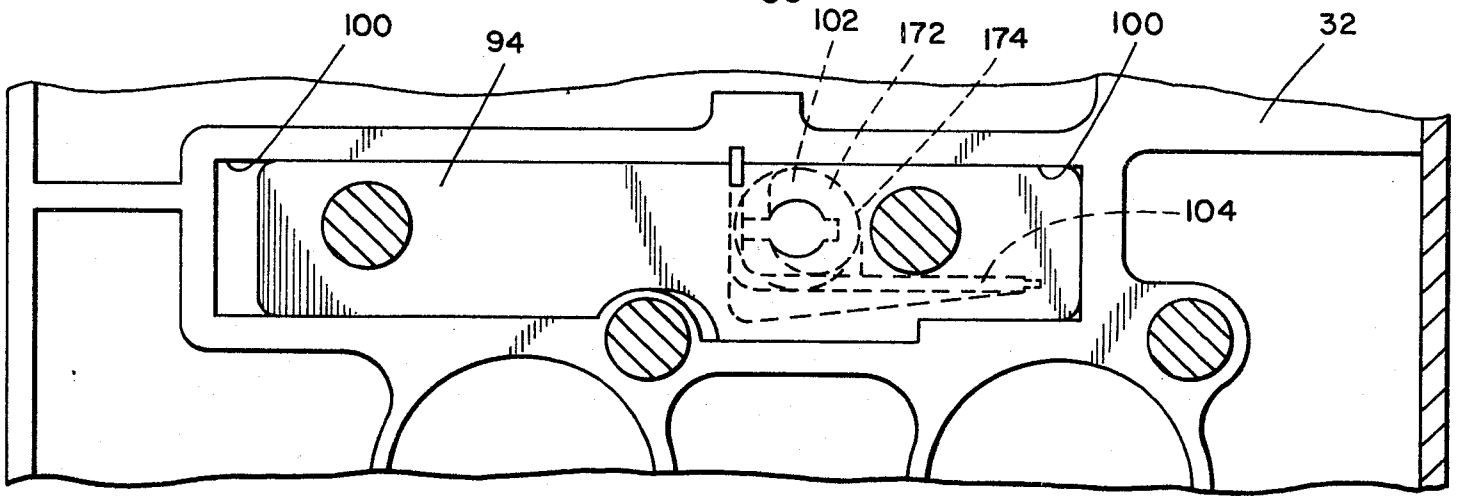
FIG. 9 is a cross-sectional plan view of the key changing release mechanism of the lock taken along the line 9—9 in FIG. 8.

Movement of the bar 94 is accomplished by rotation of post shifter 102 illustrated in FIGS. 4, 9 and 10. That is, during the sequence of operations heretofore described, the bar 94 is retained in the position illustrated in FIG. 9 by cantilever spring 104 which engages and holds cam 172 of shifter 102 in a substantially non-rotatable position in an arcuate notch 174 defined in bar 94. Notch 174 generally semi-circular and when engaged by cam 172 as shown in FIG. 9, it serves to maintain the bar 94 in the right-hand position illustrated in FIG. 9 in the channel 100. As previously explained, this insures that the tumblers 86, 88 will be in an engaged position with tumblers 70, 74.

Upon insertion of the change key tool 34 and rotation thereof by 180°, the cam 172 is rotated from the position shown in FIG. 9 to the position shown in FIG. 10. Thus, cam 172 engages the arcuate notch 174 shifting the bar 94 to the left, thereby translating the tumblers 86 and 88 out of their engaged position to the position shown in FIG. 12. Simultaneous with the translation of the bar 94 in channel 100, lobe 176 of cam 172 engages the cantilever spring 104 driving the spring 104 downward out of engagement with a notch 178 at the edge of channel 100.

Figure 13:
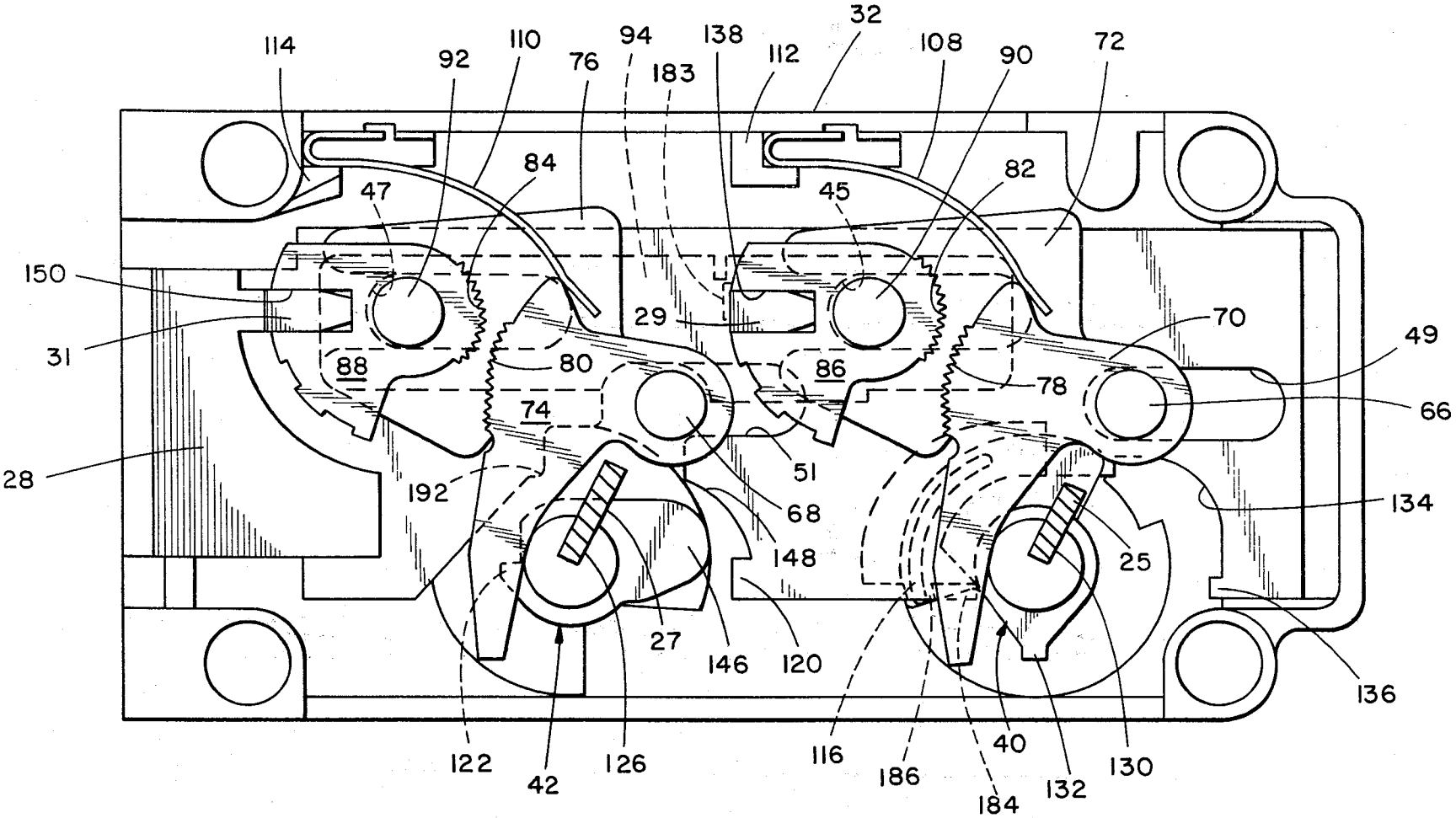
FIG. 13 is a plan view similar to FIG. 12 wherein both keys have been rotated to the key change position.

Additionally, a tang 182 of spring 104 is provided for translation into locking engagement with a matching slot or stop 183 in FIG. 4 and FIG. 13 in the backside of the bolt 28. This locks the bolt 28 in fixed position as explained below pending counterrotation of the cam 172 to the position shown in FIG. 9. When the above-described operation has been completed, the components of the lock construction assume the position illustrated in FIG. 12.

KEY CHANGING OPERATION — SECOND STEP

Figure 17:
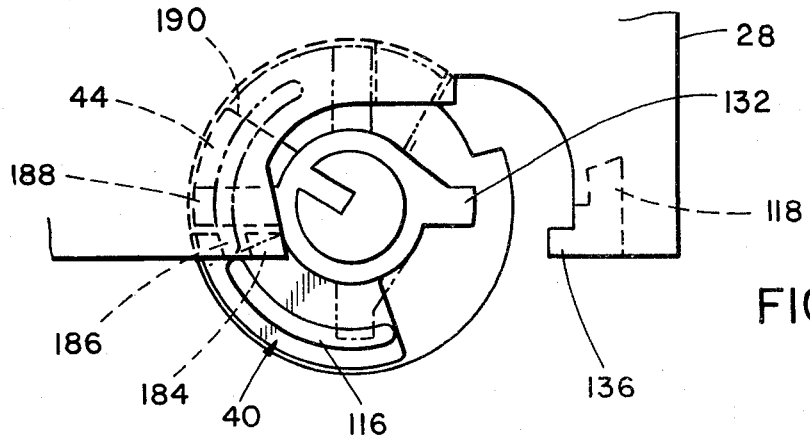
FIG. 17 illustrates the position of the guard's key shifting mechanism and bolt when placed in the key changing position.

It is then possible to begin the next step in the key changing operation. That step is illustrated by FIG. 13 and FIG. 17. Referring to the figures, the customer key 27 is rotated approximately 45° causing cam projection 146 to engage retraction surface 148 once again moving that retraction surface to the right a short distance causing the bolt 28 to be retracted a slight amount. When the bolt 28 is retracted, the cantilever spring tang 182 snaps into notch 183 on the backside of the bolt 28. This retains the bolt 28 in a locked position. This also permits removal of the key 27. Note that the spring 110 has caused all of the tumblers 74 to rotate to their full counterclockwise position. Additionally note that shifter 42 and, in particular, cam member 46 thereof, has engaged a side of projection 58 to limit the clockwise rotation of shifter 42.

Translation of the bolt 28 slightly to the right by the clockwise rotation of shifter 42 permits the guard key 25 to be rotated in a clockwise direction from the position shown in FIG. 16 to the position shown in FIG. 17. Note that FIG. 16 illustrates the relationship between the guard shifter 40 and the bolt 28 prior to rotation of the customer key shifter 46 from the position shown in FIG. 6 to that position shown in FIG. 13. In other words, FIG. 16 is an enlarged view of the guard shifter 40 as shown in FIG. 12 and FIG. 7.

The arcuate projection 116 may then be rotated past a stop 184 and through a window 186 in bolt 28. Clockwise rotation of the shifter 40 is limited by projection 56 as shown in FIG. 4 cooperating with the leading edge 190 of shifter 40. When the shifters 40 and 46 and keys 25 and 27 have been placed in position as illustrated in FIG. 13, the keys 25 and 27 may be withdrawn and replaced by alternate keys having differently shaped notches. One or both of the keys 25 and 27 may be replaced. In practice, the guard's key would be retained at a bank while a customer would receive a new key.

Reversing the procedure just described permits reengagement of the teeth 78, 82, 80 and 84 to define a new combination compatible with the newly inserted keys. This new combination will permit withdrawal of the bolt in the manner previously described.

When returning the keys to the position of FIG. 7, the guard's key 25 is first operated. Rotation is limited as described by the cooperation of projection 188 and stop 184. Subsequent to that, the customer's key 27 is rotated. The amount of rotation imparted to the customer's key is limited by engagement of cam projection 146 with lobe 192 of bolt 28. Lobe 192 serves to stop the rotation of the mechanism associated with customer key 27 inasmuch as the bolt 28 has been locked by action of the tang 182. Subsequently, after keys 25 and 27 have been placed in the position shown in FIG. 12, the key change tool 36 is rotated 180° from the position of FIG. 10 to the position of FIG. 9. This causes the assembly to assume the configuration of FIG. 7. Thereupon, the customer's key 27 and the guard key 25 may be rotated and withdrawn as previously described to lock the box utilizing the newly provided keys. Flange 160 in FIG. 10 prevents removal of guard key 25 except during initial insertion or key changing inasmuch as access slots 196 and 198 are provided in flange 160 as shown in FIG. 2.

The apparatus as described constitutes a preferred embodiment of the invention. Numerous alternative constructions are possible within the spirit and scope of the invention. In additional, various permutations of the mechanical components are possible while still remaining within the spirit of the invention. Therefore, the invention shall be limited only by the following claims and their equivalents.

What is claimed is:

1. An improved multiple key lock assembly comprising, in combination:

a housing, a bolt in said housing, said bolt slidable between a projected, locked position and a retracted unlocked position, said bolt including at least two separate locking projections extending from the bolt transverse to the direction of bolt travel;

at least two separate gate tumblers mounted for engagement with the locking projections of said bolt to prevent sliding movement of the bolt from the locked position, said gate tumblers being pivotally mounted on separate connected posts;

separate means for rotating each of said gate tumblers on said posts to a position of disengagement with the bolt locking projections to permit retraction of the bolt, said means for rotating including separate keys and separate associated pivotal key operated drive tumblers for each key, each drive tumbler engaging a radial portion of each gate tumbler to drive said gate tumbler between bolt engaged and disengaged positions, separate shifters including cam driving surfaces for slidably driving said bolt when the gate tumblers are oriented to permit bolt retraction;

means for translating the connected gate tumbler posts and gate tumblers independent of the bolt and drive tumblers to thereby separate radial engagement of the gate and drive tumblers; and means for maintaining said gate tumblers, drive tumblers and bolt in a fixed position when the gate and drive tumblers are radially separated whereby the separate keys may be removed and replaced independently to provide a new radial relationship between the gate and drive tumblers upon reengagement thereof.

2. The improved key lock assembly of claim 1 including means for biasing said tumblers toward a first position.

3. The assembly of claim 1 including a plurality of gate tumblers mounted on each post for cooperation with a like number of pivotally mounted drive tumblers.

4. The assembly of claim 1 wherein said shifters include a key shaft for receipt of a key, said key shaft having a rotation axis parallel to the pivot axis for said tumblers, said drive tumblers being positioned for engagement by said key for imparting rotational motion by engagement of said key with a lever arm extension of said drive tumblers.

5. The improved assembly of claim 1 including cooperative stops on said bolt and said shifters to limit rotation of the shifters.

6. The improved assembly of claim 1 including stops in said housing to limit the rotation of said shifters.

7. The assembly of claim 1 including cooperative stops on the bolt and shifters to provide for sequential movement of the shifters, keys and tumblers.

8. The assembly of claim 1 including cooperative stops on the bolt and shifters whereby one of said keys must be rotated partially to partially translate the bolt prior to movement of the other key and associate shifter, said other shifter and the bolt including cooperating cams which normally prevent rotation of the other shifter.

9. The assembly of claim 1 wherein the means for maintaining the gate tumblers in fixed position during separation of the gate and drive tumblers, comprise the bolt projections, said projections cooperatively engaging and holding the gate tumblers in a non-rotating position.

10. The assembly of claim 1 wherein the means for maintaining the bolt in a fixed position during separation of the gate and drive tumblers comprise a cantilever spring attached to the housing and cooperative with a slot in the bolt whenever the bolt is translated by the shifters to a key changing position.

11. The assembly of claim 1 wherein the means for maintaining the drive tumblers in a fixed position during separation of the gate and drive tumblers comprise spring means for biasing the drive tumblers to a first pivot position.

12. The assembly of claim 1 wherein one of the keys is designated as the guard key and the other key is designated as the customer key, said guard key cooperative upon rotation in one sense with one shifter and associated drive tumblers to initially orient associated gate tumblers with a locking projection and to partially retract the bolt, said bolt and other shifter including stops which prevent shifter rotation when the bolt is in the fully projected position and which disengage when the bolt is partially retracted, the customer key then being cooperative to rotate in one sense with the other shifter and engage associated drive tumblers to orient the remaining gate tumblers with a lock projection and provide additional retraction of the bolt.

13. The assembly of claim 12 wherein said customer key is held in a locked position against further rotation by the cooperative engagement of gate tumblers, drive tumblers and customer key, said key being released for further rotation in the one sense to an orientation permitting key removal while simultaneously retracting said bolt to a completely retracted position and releasing the guard key and shifter for further rotation and key removal.

* * * * *